US009738480B2

(12) United States Patent
Ito

(10) Patent No.: US 9,738,480 B2
(45) Date of Patent: Aug. 22, 2017

(54) SHEET CONVEYING APPARATUS

(71) Applicant: BROTHER KOGYO KABUSHIKI KAISHA, Nagoya-shi, Aichi-ken (JP)

(72) Inventor: Tetsuo Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/977,000

(22) Filed: Dec. 21, 2015

(65) Prior Publication Data

US 2016/0185556 A1 Jun. 30, 2016

(30) Foreign Application Priority Data

Dec. 26, 2014 (JP) ..... 2014-264120

(51) Int. Cl.

| | |
|---|---|
| ***B65H 31/00*** | (2006.01) |
| ***B65H 31/20*** | (2006.01) |
| ***B65H 29/52*** | (2006.01) |
| ***B65H 31/02*** | (2006.01) |

(52) U.S. Cl.

CPC ..... *B65H 31/20* (2013.01); *B65H 29/52* (2013.01); *B65H 31/02* (2013.01); *B65H 2301/4212* (2013.01); *B65H 2403/40* (2013.01); *B65H 2403/531* (2013.01); *B65H 2405/1124* (2013.01); *B65H 2405/11161* (2013.01); *B65H 2405/11425* (2013.01); *B65H 2405/3321* (2013.01); *B65H 2511/11* (2013.01);

(Continued)

(58) Field of Classification Search

CPC ..... B65H 31/10; B65H 29/52; B65H 31/02; B65H 2405/1124; B65H 2511/12; B65H 2405/11161; B65H 2405/11425; B65H 2511/11; B65H 31/20

See application file for complete search history.

(56) References Cited

U.S. PATENT DOCUMENTS 6,505,830 B2 * 1/2003 Kang ..... B41J 11/0055 271/223
8,109,505 B2 * 2/2012 Shih ..... B65H 31/20 271/221

(Continued)

FOREIGN PATENT DOCUMENTS

JP 61-151635 A 7/1986
JP 61151635 A * 7/1986
JP 2005-178985 A 7/2005

*Primary Examiner* — Jeremy R Severson
(74) *Attorney, Agent, or Firm* — Merchant & Gould P.C.

(57) ABSTRACT

A sheet conveying apparatus includes a discharge tray having a support surface supporting a sheet discharged by a discharge unit of a conveyor. A first stopper is provided on the support surface. A movable member is provided on the support surface between the discharge unit and the first stopper. The first stopper is changeable between a first position at which the first stopper protrudes from the support surface and a second position at which the first stopper is stored in the discharge tray. The movable member is changeable between a third position at which the movable member protrudes from the support surface and a fourth position located nearer to the support surface than the third position. The first stopper is changed from the first position to the second position in conjunction with a change of the movable member from the third position to the fourth position.

13 Claims, 7 Drawing Sheets

(52) U.S. Cl.
CPC ..... *B65H 2511/12* (2013.01); *B65H 2511/20* (2013.01); *B65H 2801/39* (2013.01)

(56) References Cited

U.S. PATENT DOCUMENTS

2012/0230748 A1* 9/2012 Okano ..... B41J 13/106
400/605
2012/0300243 A1* 11/2012 Chung ..... H04N 1/00567
358/1.13

* cited by examiner

SHEET CONVEYING APPARATUS

CROSS REFERENCE TO RELATED APPLICATION

The present application claims priority from Japanese Patent Application No. 2014-264120, which was filed on Dec. 26, 2014, the disclosure of which is herein incorporated by reference in its entirety.

BACKGROUND

Technical Field

The following disclosure relates to a sheet conveying apparatus.

Description of the Related Art

There is known a conventional sheet conveying apparatus including a conveyor, a discharge unit, and a plurality of stoppers.

The conveyor conveys a sheet along a conveyance path. The discharge unit constitutes a portion of the conveyor and discharges the sheet conveyed along the conveyance path, onto a support surface of the discharge tray. The stoppers are provided on the support surface. Each of the stoppers is spaced apart from the discharge unit at a particular distance in a discharge direction in which the sheet is discharged. The stoppers are also spaced apart from each other in the discharge direction. Each of the stoppers is mounted on the discharge tray such that a position of each stopper is changeable between a position at which the stopper protrudes from the support surface and a position at which the stopper is stored in the discharge tray.

The sheet conveying apparatus further includes a size detector for detecting the size of the conveyed sheet, a controller such as a CPU, and a stopper driving device such as a solenoid.

In the case where sheets of small size are conveyed in the sheet conveying apparatus, the controller drives the stopper driving device, based on a result of detection of the size detector, to cause the stopper corresponding to the small sheets to protrude from the support surface. When discharged onto the support surface, the small sheets are aligned by contacting the stopper protruding from the support surface.

In the case where sheets of large size are conveyed, on the other hand, the controller drives the stopper driving device, based on a result of detection of the size detector, to store the stopper corresponding to the small sheets into the discharge tray such that the stopper does not interfere with conveyance of the large sheets being discharged onto the support surface. The sheet conveying apparatus thus prevents a jam caused by the large sheets being brought into contact with the stopper corresponding to the small sheets.

SUMMARY

In the conventional sheet conveying apparatus, however, a plurality of components such as the size detector, the controller, and the stopper driving device are required to operate the stoppers, resulting in complicated construction and higher cost for components, making it difficult to reduce manufacturing costs. In the case of a sheet conveying apparatus capable of conveying sheets of various sizes, the support surface is formed to have a large size so as to match the large sheets, so that the small sheets are easily scattered on the support surface. Accordingly, improvements in alignment of small sheets are desired.

Accordingly, an aspect of the disclosure relates to a sheet conveying apparatus having a simple construction with reduced manufacturing costs and improved alignment of discharged sheets for various sizes.

In one aspect of the disclosure, a sheet conveying apparatus includes: a conveyor configured to convey a sheet along a conveyance path; and a discharge tray having a support surface configured to support the sheet discharged from the conveyor. The conveyor includes a discharge unit constituting a portion of the conveyor and configured to discharge the sheet conveyed along the conveyance path, onto the discharge tray. The discharge tray includes: a first stopper provided on the support surface; a movable member provided on the support surface between the discharge unit and the first stopper in a discharge direction in which the discharge unit discharges the sheet, the discharge direction being perpendicular to a widthwise direction; and an interlocking mechanism configured to change a position of the first stopper in conjunction with a change in position of the movable member. The first stopper is changeable in position between a first position at which the first stopper protrudes from the support surface and a second position at which the first stopper is stored in the discharge tray. The movable member is changeable in position between a third position at which the movable member protrudes from the support surface and a fourth position located nearer to the support surface than the third position. The movable member is different in position from a passage region in the widthwise direction in a state in which the movable member is located at the third position. The passage region is a region which is defined on the support surface and on which a particular sheet is conveyed. A length of the particular sheet in the widthwise direction is equal to a particular length. The interlocking mechanism is configured to change the position of the first stopper from the first position to the second position in conjunction with a change in position of the movable member from the third position to the fourth position.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Hereinafter, there will be described first and second embodiments by reference to the drawings.

First Embodiment

Figure 1:
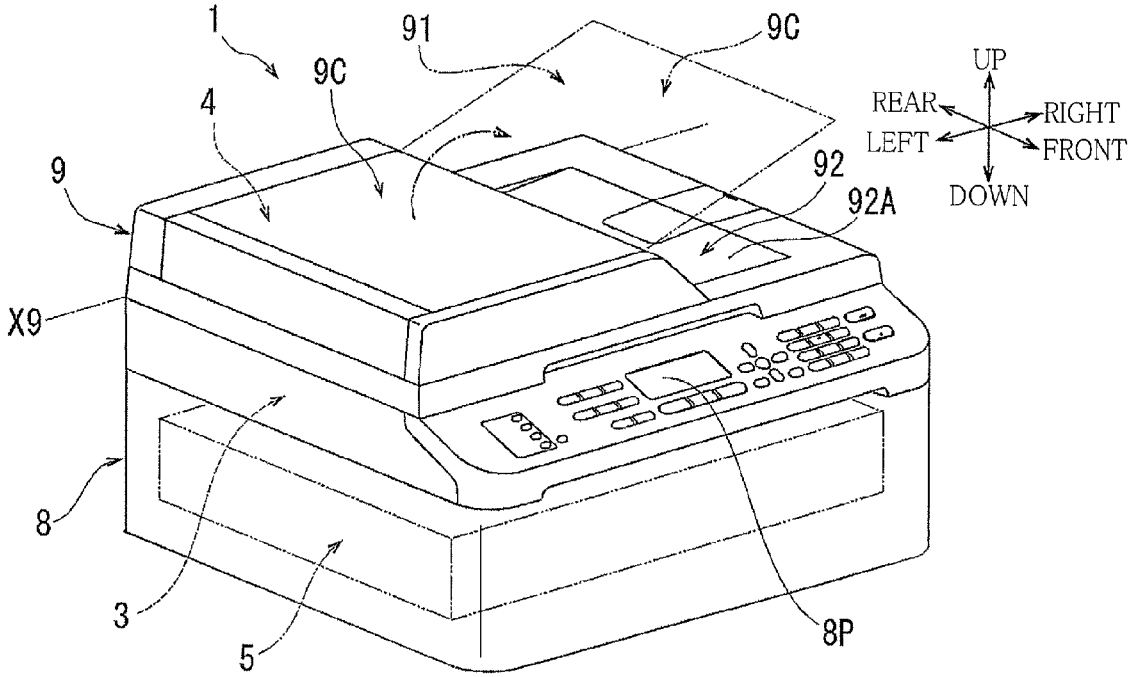
FIG. 1 is a perspective view of an image reading apparatus according to a first embodiment.

As illustrated in FIG. 1, an image reading apparatus 1 according to the first embodiment is one example of a sheet conveying apparatus. In the following description and drawings, a side on which an operation panel 8P is provided in FIG. 1 is defined as a front side of the image reading apparatus 1, and a left side when the image reading apparatus 1 is viewed from the front side is defined as a left side. A front and rear direction, a right and left direction, and an up and down direction are defined with respect to these sides.

Overall Construction

Figure 2:
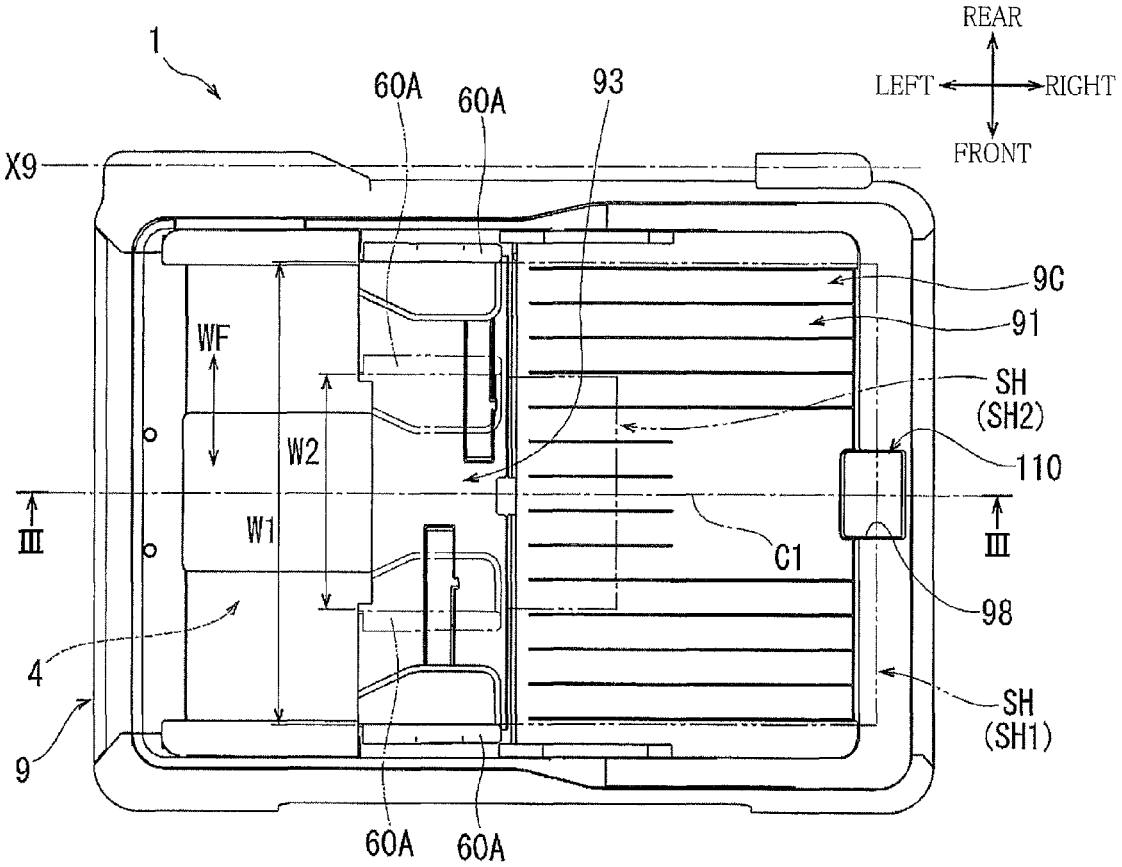
FIG. 2 is a top view of the image reading apparatus according to the first embodiment.
Figure 3:
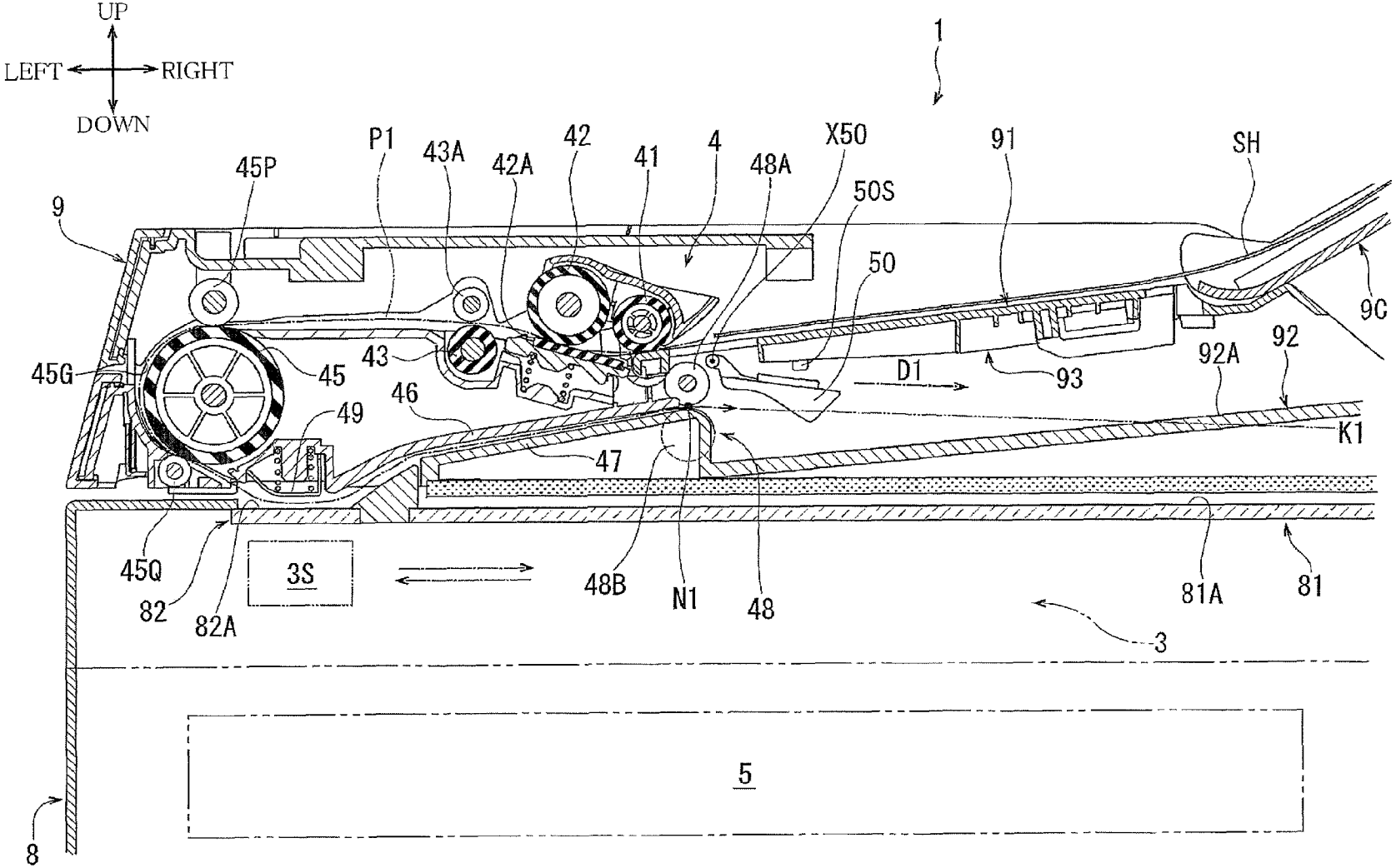
FIG. 3 is a partial cross-sectional view taken along line in FIG. 2.

As illustrated in FIGS. 1-3, the image reading apparatus 1 includes a main body 8, an opening and closing member 9, an image forming unit 5, a reading unit 3, and a conveyor 4. The main body 8 is substantially shaped like a flat box. As illustrated in FIG. 1, a front surface of the main body 8 is provided with the operation panel 8P such as a touchscreen.

The image forming unit 5 is accommodated in a lower portion of the main body 8. The image forming unit 5 performs ink-jet printing or laser printing, for example, to form an image on a sheet. The reading unit 3 is accommodated in an upper portion of the main body 8. The reading unit 3 reads an image recorded on a document. The conveyor 4 is provided in the opening and closing member 9. The conveyor 4 supplies sheets SH one by one from a supply tray 91 to a conveyance path P1 illustrated in FIG. 3 and conveys each sheet SH along the conveyance path P1 for the reading unit 3 to read an image recorded on the sheet SH.

As illustrated in FIG. 3, a first platen glass 81 and a second platen glass 82 are disposed on an upper surface of the main body 8. An upper surface of the first platen glass 81 serves as a document support surface 81A. When the reading unit 3 reads an image recorded on a stationary document, the document support surface 81A supports a lower surface of the document. Examples of documents to be read include normal sheets, OHP sheets, and books. The second platen glass 82 is a narrow glass elongated in the front and rear direction and disposed to the left of the first platen glass 81. An upper surface of the second platen glass 82 serves as a reading surface 82A. When the reading unit 3 reads an image recorded on each sheet SH conveyed by the conveyor 4, the reading surface 82A guides a lower surface of the conveyed sheet SH. In the present embodiment, a subject of which image is to be read using the document support surface 81A will be referred to as "document", and a subject of which image is to be read during conveyance thereof by the conveyor 4 will be referred to as "sheet SH". The document and the sheet SH may be substantially the same as each other.

As illustrated in FIG. 1, the opening and closing member 9 is supported by hinges, not shown, arranged on an upper edge of a rear surface of the main body 8, such that the opening and closing member 9 is pivotable about an opening and closing axis X9 extending in the right and left direction. In a closed state illustrated in FIGS. 1-3, the opening and closing member 9 covers the document support surface 81A from above. Though not shown, the opening and closing member 9 is pivoted about the opening and closing axis X9 such that its front end portion is moved upward and rearward, so that the opening and closing member 9 is moved to its open position at which the document support surface 81A is exposed. This movement allows a user to place a document onto the document support surface 81A.

As illustrated in FIG. 3, the reading unit 3 includes a reading sensor 3S and a scanning mechanism, not shown. The reading sensor 3S is accommodated in the upper portion of the main body 8. The reading sensor 3S is one example of a reading device. The scanning mechanism reciprocates the reading sensor 3S in the main body 8 in the right and left direction within an area under the document support surface 81A and the reading surface 82A. When reading an image recorded on a document supported on the document support surface 81A, the reading sensor 3S reads the image while moving under the document support surface 81A. Under the reading surface 82A, the reading sensor 3S is stopped at a predetermined stationary reading position. When reading an image recorded on the sheet SH being conveyed by the conveyor 4, the reading sensor 3S is stopped at the stationary reading position. The reading sensor 3S is a well-known image reading sensor such as a contact image sensor (CIS) and a charge coupled device (CCD).

The conveyor 4 is provided in the opening and closing member 9 and includes the supply tray 91 and a discharge tray 92. The supply tray 91 is formed on a right portion of the opening and closing member 9 by opening a cover 9C from its closed position indicated by the solid line in FIG. 1 to a position indicated by the two-dot chain line in FIG. 1.

As illustrated in FIGS. 2 and 3, the supply tray 91 is constituted by the cover 9C and a chute 93 provided to the left of the opened cover 9C. An upper surface of the supply tray 91 is a flat surface inclined so as to be lower at its left portion than at its right portion. The supply tray 91 is capable of supporting a lower surface of a lowermost one of a plurality of stacked sheets SH to be conveyed by the conveyor 4 for reading.

As illustrated in FIG. 2, a pair of guides 60A, 60A slidable in the front and rear direction are provided on the chute 93 that is a portion of the supply tray 91. The pair of guides 60A, 60A are opposed to each other in the front and rear direction. The pair of guides 60A, 60A are coupled to each other by a rack and pinion mechanism, not shown. As indicated by the solid lines and the two-dot chain lines in FIG. 2, the pair of guides 60A, 60A are moved toward and away from each other so as to be brought into contact with front and rear edges of the sheets SH supported on the supply tray 91. The pair of guides 60A, 60A are capable of aligning various sizes of the sheets SH. Specifically, the pair of guides 60A, 60A are capable of positioning the sheets SH on the supply tray 91 in the front and rear direction with respect to the center of the supply tray 91. The front and rear direction in which the pair of guides 60A, 60A are slid may be hereinafter referred to as "widthwise direction WF".

In the present embodiment, the largest ones of various sizes of the sheets SH conveyable by the conveyor 4 are the A4 size and the letter size. Sheets of these sizes are defined as sheets SH1 of the maximum size. In the case where the maximum-size sheet SH1 is positioned on the supply tray 91, the pair of guides 60A, 60A indicated by the solid lines in FIG. 2 are spaced apart from each other in the front and rear direction at a distance equal to the length W1 of the maximum-size sheet SH1 in the widthwise direction WF, and the pair of guides 60A, 60A hold front and rear edges of the maximum-size sheet SH1.

In the present embodiment, the sheets SH conveyable by the conveyor 4 include sheets smaller in size than the maximum-size sheet SH1, such as sheets of the A6 size and sheets of the postcard size smaller than the A6 size. The A6 sheet is defined as a sheet SH2. The A6 sheet SH2 is one example of a particular sheet. In the case where the A6 sheet SH2 is positioned on the supply tray 91, the pair of guides 60A, 60A indicated by the two-dot chain lines in FIG. 2 are spaced apart from each other in the front and rear direction at a distance equal to the length W2 of the A6 sheet SH2 in the widthwise direction WF, and the pair of guides 60A, 60A hold front and rear edges of the A6 sheet SH2.

Though not shown, in the case where each of (i) the sheets SH of sizes between the maximum-size sheet SH1 and the A6 sheet SH2 and (ii) the sheet SH of the postcard size smaller than the A6 size is positioned on the supply tray 91, the pair of guides 60A, 60A are spaced apart from each other in the front and rear direction at a distance equal to the length of the sheet in the widthwise direction WF, and the pair of guides 60A, 60A hold front and rear edges of the sheet SH.

As illustrated in FIG. 3, the discharge tray 92 is disposed under the supply tray 91, and these trays 91, 92 overlap each other in the up and down direction. An upper surface of the discharge tray 92 serves as a support surface 92A. The sheets SH for which images are read by the reading sensor 3S and which are discharged by the conveyor 4 are stacked on the support surface 92A of the discharge tray 92. As illustrated in FIGS. 4-6C, the support surface 92A is a flat surface inclined so as to be higher at its right portion than at its left portion. The discharge tray 92 is provided with a first stopper 100, first and second movable members 121, 122, an interlocking mechanism 140, and a second stopper 110 which will be described below in detail.

As illustrated in FIG. 3, the conveyor 4 defines the conveyance path P1 as a space surrounded by (i) guide surfaces extending in the opening and closing member 9 so as to be contactable respectively with one and the other surfaces of the sheet SH and (ii) conveying rollers which will be described below, and (iii) other components. The conveyor 4 conveys the sheet SH along the conveyance path P1. The conveyance path P1 first extends leftward from the supply tray 91 substantially in the horizontal direction. The conveyance path P1 curves downward, then extends rightward from the downward curved portion for short distance along the reading surface 82A, and finally extends to the discharge tray 92 while inclined upward to a right end of the conveyance path P1.

A conveying direction in which the sheet SH is conveyed by the conveyor 4 is the left direction in the upper substantially horizontal portion of the conveyance path P1. The conveying direction changes from the left direction to the right direction in the downward curved portion of the conveyance path P1. The conveying direction is the right direction in a portion of the conveyance path P1 which extends to the discharge tray 92 from a right end of the reading surface 82A defining the conveyance path P1 from below. It is noted that the shape of the conveyance path P1 and the direction in which the conveyance path P1 extends are one example.

The conveyor 4 includes a supply roller 41, a separating roller 42, and a separating pad 42A at a portion of the conveyance path P1 near the supply tray 91. The supply roller 41 supplies the sheet SH supported on the supply tray 91, to the separating roller 42 located downstream of the supply roller 41 in the conveying direction. The separating roller 42 cooperates with the separating pad 42A to separate overlapping sheets SH one by one to convey each sheet SH to a downstream side of the separating roller 42 in the conveying direction.

The conveyor 4 includes a pair of conveying rollers 43, 43A disposed downstream of the separating roller 42 and the separating pad 42A in the conveying direction. The pair of conveying rollers 43, 43A convey the sheets SH separated one by one by the separating roller 42 and the separating pad 42A, to a downstream side of the pair of conveying rollers 43, 43A in the conveying direction.

The conveyor 4 includes a large-diameter conveying roller 45, a curved guide surface 45G and pinch rollers 45P, 45Q at the downward curved portion of the conveyance path P1. An outer circumferential surface of the conveying roller 45 serves as an inner guide surface of the downward curved portion of the conveyance path P1. The curved guide surface 45G is spaced apart from the outer circumferential surface of the conveying roller 45 at a predetermined distance therebetween. The curved guide surface 45G serves as an outer guide surface of the downward curved portion of the conveyance path P1. The conveying roller 45 cooperates with each of the pinch rollers 45P, 45Q contacting an outer circumferential surface of the conveying roller 45 to convey the sheet SH to the reading surface 82A.

The conveyor 4 includes a pressing member 49 disposed above and opposed to the reading surface 82A. The pressing member 49 presses an upper surface of the sheet SH conveyed from the conveying roller 45, to bring the sheet SH into contact with the reading surface 82A.

The conveyor 4 includes guide walls 47, 46 arranged to the right of the pressing member 49. The guide wall 47 defines, from below, a portion of the conveyance path P1 which is located to the right of the pressing member 49 and inclined upward. The guide wall 46 is located over the guide wall 47 to form a space between the guide wall 46 and the guide wall 47. The guide wall 46 defines, from above, the portion of the conveyance path P1 which is located to the right of the pressing member 49 and inclined upward.

The conveyor 4 further includes a discharge unit 48. The discharge unit 48 discharges the sheet SH from the conveyance path P1 onto the discharge tray 92. The discharge unit 48 includes two (front and rear) pairs of discharge rollers 48A and nip rollers 48B at the portion of the conveyance path P1 which is located to the right of the pressing member 49 and inclined upward.

The discharge rollers 48A and the nip rollers 48B face the discharge tray 92. The discharge rollers 48A are located near a right end of the guide wall 46. The nip rollers 48B are located near a right end of the guide wall 47. The nip rollers 48B are located under and opposed to the respective discharge rollers 48A so as to form a nip position N1. The discharge rollers 48A and the nip rollers 48B at the nip position N1 nip the sheet SH having passed through an area over the reading surface 82A and convey the sheet SH in a discharge direction D1 to discharge it onto the support surface 92A of the discharge tray 92.

Figure 4:
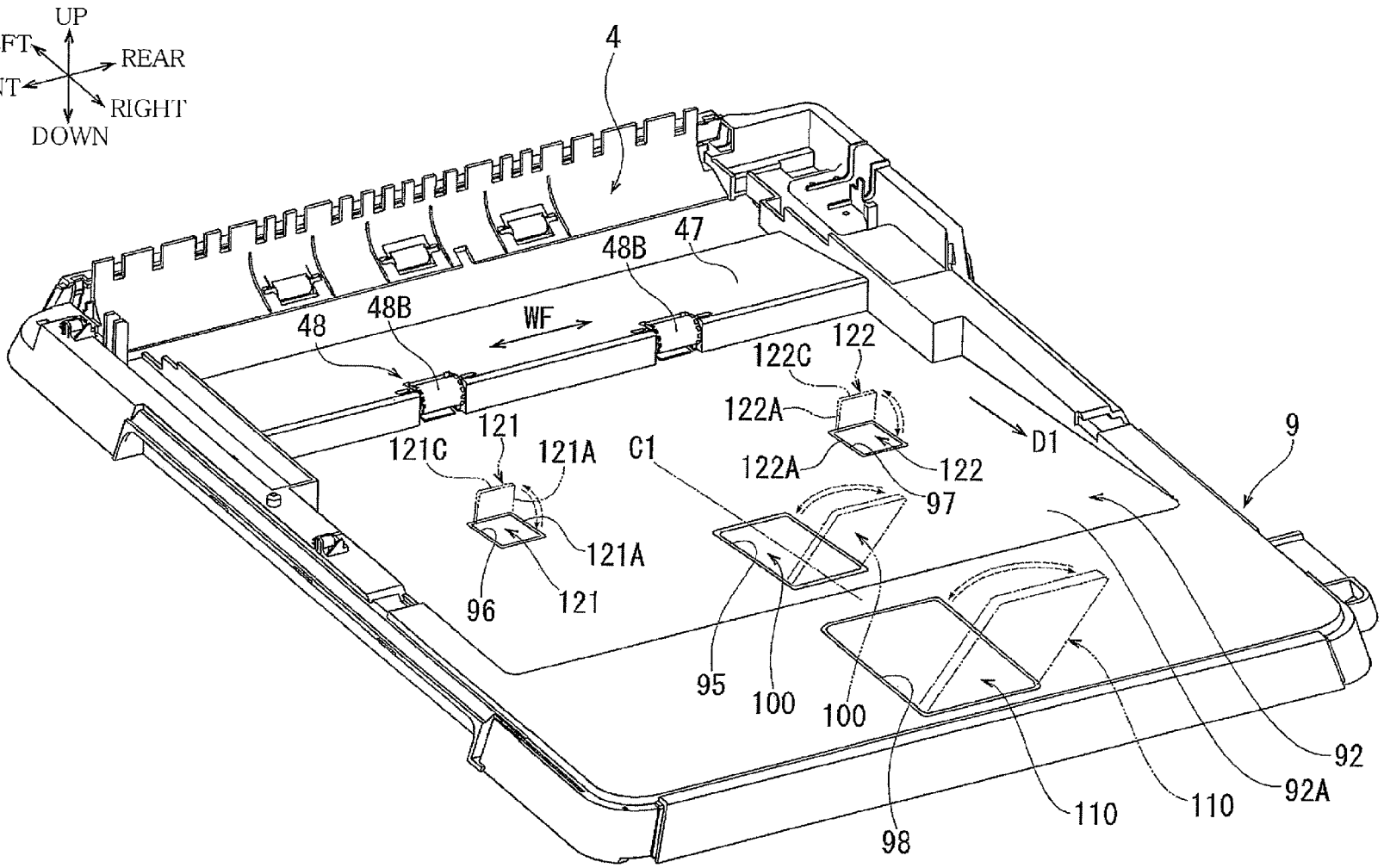
FIG. 4 is a perspective view illustrating a discharge unit, a discharge tray, first and second stoppers, a movable member, and other components.
Figure 5:
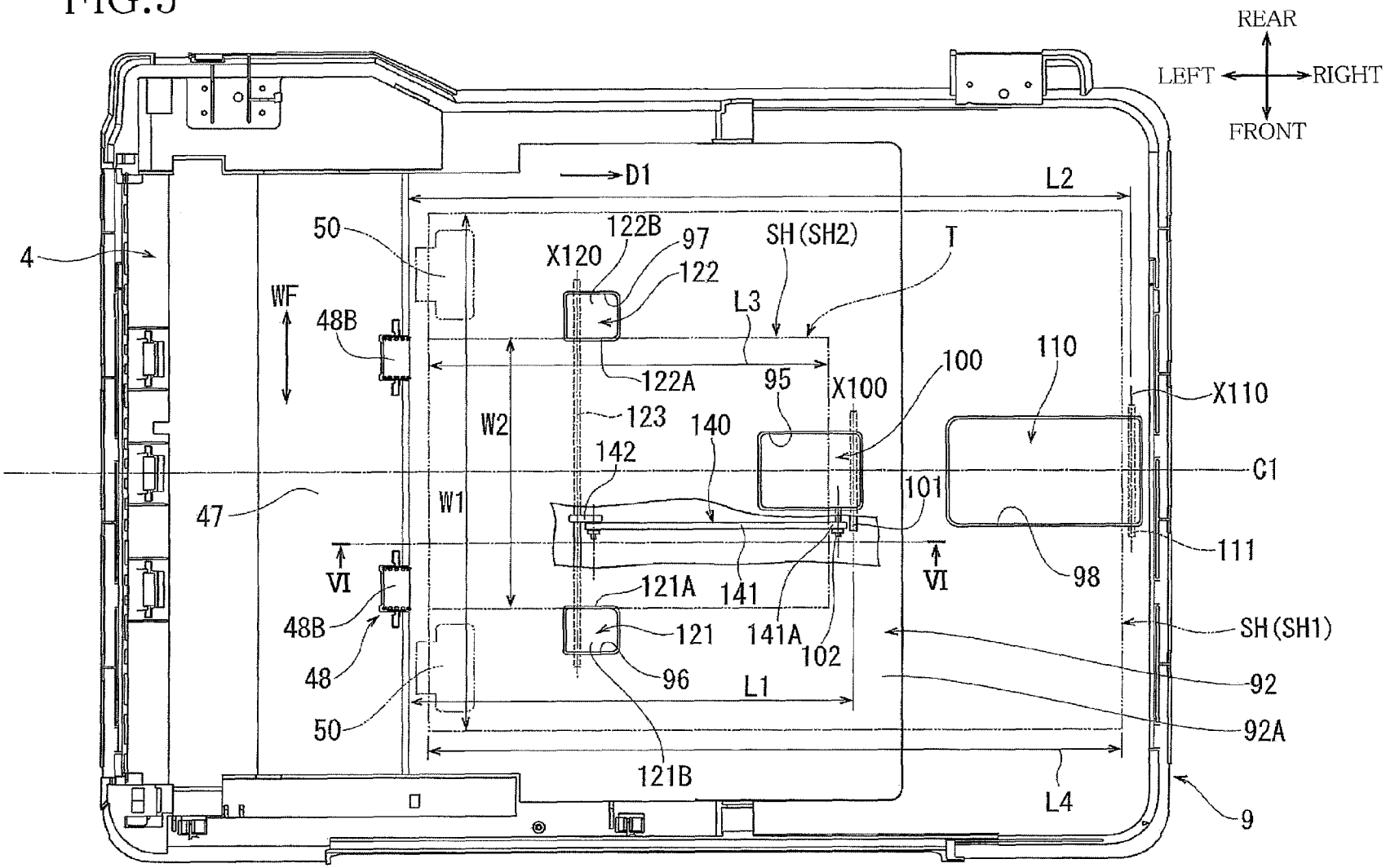
FIG. 5 is a top view illustrating the discharge unit, the discharge tray, the first and second stoppers, the movable member, an interlocking mechanism, and other components.
Figures 6A, 6B, 6C:
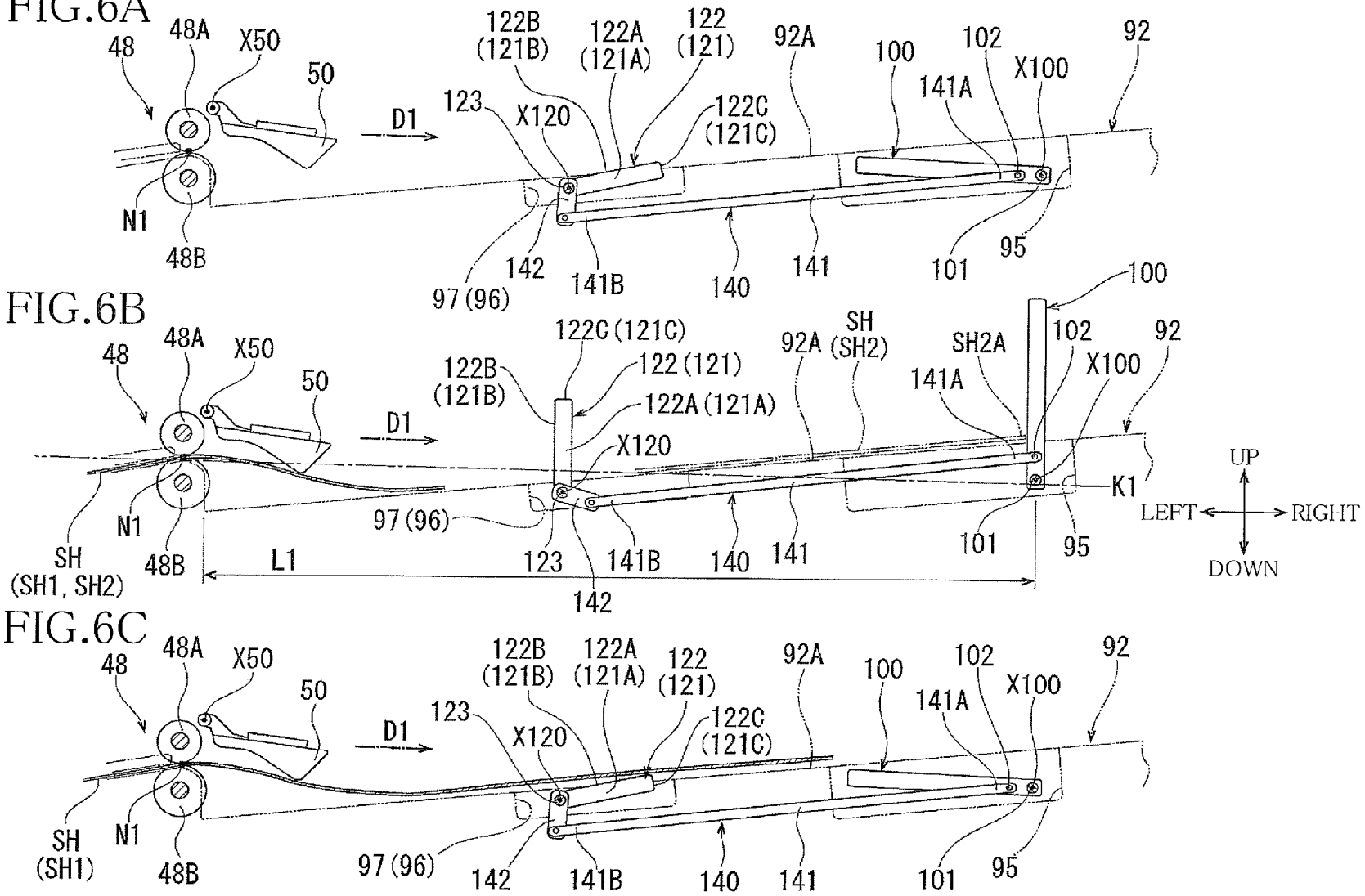
FIGS. 6A through 6C are schematic cross-sectional views taken along line VI-VI in FIG. 5 for explaining operations of a first stopper, the movable member, and the interlocking mechanism.

As illustrated in FIGS. 4 and 5, the widthwise direction WF coinciding with the front and rear direction is perpendicular to the discharge direction D1 directed rightward. As illustrated in FIGS. 3 and 6A-6C, the discharge direction D1 is slightly inclined downward to the right. Thus, an imaginary line K1 extending in the discharge direction D1 through the nip position N1 intersects the support surface 92A of the discharge tray 92 which is inclined so as to be higher at its right portion than at its left portion. With this construction, as illustrated in FIGS. 6B and 6C, the sheet SH discharged by the discharge rollers 48A and the nip rollers 48B is conveyed toward a downstream side in the discharge direction D1, with a leading edge portion of the sheet SH being rubbed against the support surface 92A.

As illustrated in FIGS. 3, 5, and 6A-6C, the discharge unit 48 includes a pair of front and rear pressing members 50. The pressing members 50 are provided downstream of the discharge rollers 48A and the nip rollers 48B in the discharge direction D1. Left end portions of the respective pressing members 50 are supported by an inside frame, not shown, in the opening and closing member 9 so as to be pivotable about a pivot axis X50. The pivot axis X50 is located above and to the right of the discharge rollers 48A and extends in the front and rear direction.

Torsion coil springs, not shown, are mounted on the respective pressing members 50. The torsion coil springs urge the respective pressing members 50 in the clockwise direction in FIGS. 3 and 6A-6C about the pivot axis X50. As a result, the pressing members 50 are urged such that their respective right end portions are to be moved toward the support surface 92A of the discharge tray 92.

As illustrated in FIGS. 6B and 6C, the sheet SH discharged by the discharge rollers 48A and the nip rollers 48B is conveyed toward a downstream side, i.e., the support surface 92A, in the discharge direction D1 while pressed by the pressing members 50.

As illustrated in FIG. 3, contact portions 50S are provided on a lower surface of the chute 93. The contact portions 50S protrude downward and are located above the respective pressing members 50 so as to be spaced apart therefrom. In the case where the pressing members 50 are pivoted in the counterclockwise direction in FIG. 3 by pressing of the sheet SH being discharged, the contact portions 50S contact the respective pressing members 50 to prevent the pressing members 50 from moving away from the sheet SH.

Image Reading Operation

When the reading unit 3 reads an image recorded on a document supported on the document support surface 81A, the scanning mechanism, not shown, of the reading unit 3 reciprocates the reading sensor 3S in the right and left direction within an area extending from a position under a left edge of the document support surface 81A to a position under a right edge of the document support surface 81A. During this reciprocation, the reading sensor 3S reads the image recorded on the document supported on the document support surface 81A. Upon completion of the reading, the scanning mechanism, not shown, moves the reading sensor 3S a right end portion to a left end portion in the reading unit 3, so that the reading sensor 3S is moved back to its original position.

When the reading unit 3 reads an image recorded on the sheet SH placed on the suppl5y tray 91, the scanning mechanism, not shown, of the reading unit 3 moves the reading sensor 3S to the stationary reading position located under the reading surface 82A. When the conveyor 4 thereafter conveys the sheets SH one by one from the supply tray 91 along the conveyance path P1, each sheet SH is conveyed through a position over the reading sensor 3S positioned at the stationary reading position, while contacting the reading surface 82A. During this conveyance, the reading sensor 3S reads an image recorded on the sheet SH passing through the position over the reading sensor 3S. After the image reading, as illustrated in FIGS. 6B and 6C, the sheet SH is discharged onto the support surface 92A of the discharge tray 92 by the discharge rollers 48A and the nip rollers 48B.

FIG. 5 illustrates a relative positional relationship between the support surface 92A of the discharge tray 92 and each of the maximum-size sheet SH1 (the A4 sheet in the present embodiment) and the A6 sheet SH2 supported on the support surface 92A. A center line C1 of the support surface 92A extends in the right and left direction through a midpoint of the length W1 of the maximum-size sheet SH1 discharged on the support surface 92A in the widthwise direction WF and through a midpoint of the length W2 of the A6 sheet SH2 discharged on the support surface 92A in the widthwise direction WF. Thus, the sheets SH (including the sheets SH1 and SH2) discharged on the discharge tray 92 are supported on the support surface 92A with center alignment.

Here, it is assumed that a region through which the A6 sheet SH2 passes on the support surface 92A when discharged is defined as "passage region T" illustrated in FIG. 5. The length of the passage region T in the widthwise direction WF is equal to the length W2 of the A6 sheet SH2 in the widthwise direction WF.

Constructions of First Stopper, Movable Member, Interlocking Mechanism, and Second Stopper As illustrated in FIGS. 4-6C, the image reading apparatus 1 includes the first stopper 100, the first movable member 121, the second movable member 122, the interlocking mechanism 140, and the second stopper 110. In explanation of the constructions of the first stopper 100, the first and second movable members 121, 122, and the second stopper 110, the up and down direction and the front and rear direction are defined with respect to a state in which these components are laid as indicated by the solid lines in FIGS. 4, 5, 6A, and 6C.

The first stopper 100 is shaped like a plate having a substantially rectangular shape. The first stopper 100 is provided on the support surface 92A of the discharge tray 92. A first storage 95 is recessed in a central portion of the support surface 92A in the widthwise direction WF, and this first storage 95 is a substantially rectangular hole having a closed bottom. The first storage 95 is located in an intermediate portion of the support surface 92A in the discharge direction D1. The first stopper 100 is stored in the first storage 95 in a state in which the first stopper 100 is laid.

As illustrated in FIGS. 5 and 6A-6C, the first stopper 100 includes a shaft 101. The shaft 101 has a circular cylindrical shape so as to extend through a right end portion of the first stopper 100 in its stored state and protrude therefrom frontward and rearward. Front and rear end portions of the shaft 101 are respectively supported by bearings, not shown, provided in the discharge tray 92. With this construction, the first stopper 100 is supported by the discharge tray 92 so as to be pivotable about a first axis X100 extending parallel to the widthwise direction WF. A position of the first stopper 100 is changeable between a laid position indicated by the solid lines in FIGS. 4, 5, 6A, and 6C and a standing position indicated by the two-dot chain lines in FIG. 4 and the solid lines in FIG. 6B.

The position of the first stopper 100 which is indicated by the two-dot chain lines in FIG. 4 and the solid lines in FIG. 6B is defined as a first position. The first stopper 100 at the first position protrudes substantially upright from the support surface 92A. The position of the first stopper 100 which is indicated by the solid lines in FIGS. 4, 5, 6A, and 6C is defined as a second position. As illustrated in FIGS. 6B and 6C, the first stopper 100 is pivoted to the second position by falling from the first position toward an upstream side in the discharge direction D1. As illustrated in FIG. 6C, the entire first stopper 100 is stored in the first storage 95 at the second position. As a result, the first stopper 100 located at the second position has no portion protruding from the support surface 92A, resulting in no inverse step in the discharge direction D1.

As illustrated in FIGS. 5 and 6B, the first axis X100 about which the first stopper 100 is pivoted is spaced apart from the discharge unit 48 at a first distance L1 in the discharge direction D1. As illustrated in FIG. 5, the length L3 of the A6 sheet SH2 in the discharge direction D1 is less than the first distance L1. Thus, the first stopper 100 located at the first position illustrated in FIG. 6B is located downstream of the passage region T (illustrated in FIG. 5) for the A6 sheet SH2 in the discharge direction D1. This construction allows the first stopper 100 at the first position to contact the A6 sheet SH2 from a downstream side in the discharge direction D1. In other words, the first stopper 100 at the first position is contactable with a downstream edge of the A6 sheet SH2 in the discharge direction D1.

As illustrated in FIGS. 4-6C, each of the first and second movable members 121, 122 is shaped like a plate having a substantially rectangular shape and smaller in size than the first stopper 100. The first and second movable members 121, 122 are also provided on the support surface 92A of the discharge tray 92. Each of the first and second movable members 121, 122 is one example of a movable member.

A pair of front and rear movable-member storages 96, 97 are recessed in the support surface 92A. The movable-member storages 96, 97 are formed between the discharge unit 48 and the first stopper 100 in the discharge direction D1. The front movable-member storage 96 is located in front of the center line C1 of the support surface 92A. The rear movable-member storage 97 is located at the rear of the center line C1 of the support surface 92A. The first movable member 121 is stored in the front movable-member storage 96 in a state in which the first movable member 121 is laid. The second movable member 122 is stored in the rear movable-member storage 97 in a state in which the second movable member 122 is laid. That is, the first and second movable members 121, 122 are arranged between the discharge unit 48 and the first stopper 100 in the discharge direction D1.

As illustrated in FIG. 5, the first movable member 121 and the second movable member 122 are coupled to each other by a transmission shaft 123. The transmission shaft 123 has a circular cylindrical shape extending in the front and rear direction so as to connect between a left end portion of the first movable member 121 and a left end portion of the second movable member 122. A front end portion of the transmission shaft 123 protrudes frontward from the first movable member 121. A rear end portion of the transmission shaft 123 protrudes rearward from the second movable member 122. Front and rear end portions of the transmission shaft 123 are respectively supported by bearings, not shown, provided in the discharge tray 92. With this construction, the first and second movable members 121, 122 are supported by the discharge tray 92 so as to be pivotable about a second axis X120 extending parallel to the widthwise direction WF. A position of each of the first and second movable members 121, 122 is changeable between a laid position indicated by the solid lines in FIGS. 4, 5, 6A, and 6C and a standing position indicated by the two-dot chain lines in FIG. 4 and the solid lines in FIG. 6B.

The position of each of the first and second movable members 121, 122 which is indicated by the two-dot chain lines in FIG. 4 and the solid lines in FIG. 6B is defined as a third position. Each of the first and second movable members 121, 122 at the third position protrudes substantially upright from the support surface 92A. The position of each of the first and second movable members 121, 122 which is indicated by the solid lines in FIGS. 4, 5, 6A, and 6C is defined as a fourth position. As illustrated in FIGS. 6B and 6C, each of the first and second movable members 121, 122 is pivoted to the fourth position by falling from the third position toward a downstream side in the discharge direction D1. As illustrated in FIG. 6C, when located at the fourth position, each of the first and second movable members 121, 122 is located near the support surface 92A, specifically, a right end portion of each of the first and second movable members 121, 122 is located above the support surface 92A, and the other portion is stored in a corresponding one of the movable-member storages 96, 97. In this state, the right end portion of each of the first and second movable members 121, 122 located at the fourth position forms no inverse step in the discharge direction D1.

As illustrated in FIG. 5, the front first movable member 121 is disposed in front of the passage region T through which the A6 sheet SH2 is to be conveyed, that is, the front first movable member 121 is disposed on one of opposite sides of the passage region T in the widthwise direction WF. A rear surface of the front first movable member 121 serves as a restraining surface 121A. The restraining surface 121A abuts on a front end of the passage region T.

The rear second movable member 122 is disposed at the rear of the passage region T through which the A6 sheet SH2 is to be conveyed, that is, the rear second movable member 122 is disposed on the other of opposite sides of the passage region T in the widthwise direction WF. A front surface of the rear second movable member 122 serves as a restraining surface 122A. The restraining surface 122A abuts on a rear end of the passage region T when viewed from above.

A distance between the front restraining surface 121A and the rear restraining surface 122A in the widthwise direction WF is set at a value slightly greater than the length W2 of the A6 sheet SH2 in the widthwise direction WF regardless of whether each of the first and second movable members 121, 122 is located at the third position or the fourth position.

As illustrated in FIG. 6B, the first movable member 121 and the second movable member 122 have respective pressing surfaces 121B, 122B. When each of the first movable member 121 and the second movable member 122 is located at the third position, each of the pressing surfaces 121B, 122B stands substantially upright on the support surface 92A and oriented toward an upstream side in the discharge direction D1. At the third position, distal edges 121C, 122C of the respective first and second movable members 121, 122 are located above the imaginary line K1.

In top view as illustrated in FIG. 5, the front first movable member 121 is opposed to the front pressing member 50 in the discharge direction D1, and the rear first movable member 121 is opposed to the rear pressing member 50 in the discharge direction D1. In side view as illustrated in FIG. 6B, the first and second movable members 121, 122 at the third position are opposed to the respective front and rear pressing members 50 in the discharge direction D1. That is, the first and second movable members 121, 122 located at the third position overlap the respective front and rear pressing members 50 in position in the discharge direction D1. In other words, in top view as illustrated in FIG. 5, a range occupied by the front first movable member 121 in the widthwise direction WF (or a range occupied by the pressing surface 121B in the widthwise direction WF) overlaps, in the widthwise direction WF, a range occupied by the front pressing member 50 in the widthwise direction WF (or a range occupied by a portion of the front pressing member 50 which presses the sheet SH in the widthwise direction WF), and likewise a range occupied by the rear first movable member 121 in the widthwise direction WF (or a range occupied by the pressing surface 122B in the widthwise direction WF) overlaps, in the widthwise direction WF, a range occupied by the rear pressing member 50 in the widthwise direction WF (or a range occupied by a portion of the rear pressing member 50 which presses the sheet SH in the widthwise direction WF). Also, in side view as illustrated in FIG. 6B, a range occupied by the first and second movable members 121, 122 at the third position in the up and down direction (or a range occupied by the pressing surfaces 121B, 122B in the up and down direction) overlaps, in the widthwise direction WF, a range occupied by the pressing members 50 in the up and down direction overlaps, in the widthwise direction WF, portions of the pressing members 50 which presses the sheet SH.

The first and second movable members 121, 122 at the third position do not contact the A6 sheet SH2 discharged from the discharge unit 48 but are contactable with the sheet SH greater than the A6 sheet SH2 in length in the widthwise direction WF (e.g., the maximum-size sheet SH1). Also, the restraining surfaces 121A, 122A of the respective first and second movable members 121, 122 at the third position are capable of restraining the front and rear edges of the A6 sheet SH2 passing through the passage region T. That is, the restraining surfaces 121A, 122A of the respective first and second movable members 121, 122 at the third position are capable of restraining opposite edges of the A6 sheet SH2 in the widthwise direction WF on the passage region T. In other words, the restraining surfaces 121A, 122A of the respective first and second movable members 121, 122 at the third position are capable of preventing the A6 sheet SH2 from moving to positions outside the restraining surfaces 121A, 122A in the widthwise direction WF.

The interlocking mechanism 140 is provided between the first stopper 100 and the first and second movable members 121, 122 in the right and left direction. The interlocking mechanism 140 includes a coupling member 141 shaped substantially like a rod.

As illustrated in FIGS. 5 and 6A, a front surface of the first stopper 100 is provided with a transmitter 102 in the form of a circular cylindrical shaft which protrudes frontward. In the state in which the first stopper 100 is located at the second position, the transmitter 102 is spaced apart from and located to the left of the first axis X100. The coupling member 141 extends in the right and left direction and has one end 141A coupled to the first stopper 100 via the transmitter 102.

A pivoting member 142 is attached to the transmission shaft 123 so as to be rotatable together with the transmission shaft 123. The pivoting member 142 is disposed nearer to the first movable member 121 than the center line C1 in the widthwise direction WF. The pivoting member 142 protrudes downward. The other end 141B of the coupling member 141 is coupled to a distal end portion of the pivoting member 142. With these constructions, the coupling member 141 couples the first stopper 100 and the first and second movable members 121, 122 to each other via the transmitter 102, the pivoting member 142, and the transmission shaft 123.

When the first stopper 100 is pivoted from the second position illustrated in FIG. 6A to the first position illustrated in FIG. 6B, the coupling member 141 is pulled by the transmitter 102 and thereby moved rightward, and the distal end portion of the pivoting member 142 is pulled by the coupling member 141 and thereby moved rightward. As a result, the transmission shaft 123 is rotated in the counter-clockwise direction in FIG. 6, so that each of the first and second movable members 121, 122 is pivoted from the fourth position to the third position. Conversely, when the first stopper 100 is pivoted from the first position illustrated in FIG. 6B to the second position illustrated in FIG. 6A, the coupling member 141 and other components are operated in reverse, so that each of the first and second movable members 121, 122 is pivoted from the third position to the fourth position.

When each of the first and second movable members 121, 122 is pivoted from the third position illustrated in FIG. 6B to the fourth position illustrated in FIG. 6A, the transmission shaft 123 is rotated in the clockwise direction in FIG. 6A-6C, so that the distal end portion of the pivoting member 142 is moved leftward. As a result, the coupling member 141 is pulled by the pivoting member 142 and thereby moved leftward, and the transmitter 102 is pulled leftward, so that the first stopper 100 is pivoted from the first position to the second position.

Thus, the interlocking mechanism 140 is capable of pivoting each of the first and second movable members 121, 122 from the fourth position to the third position in conjunction with the pivotal movement of the first stopper 100 from the second position to the first position. Furthermore, the interlocking mechanism 140 is capable of pivoting the first stopper 100 from the first position to the second position in conjunction with the pivotal movement of each of the first and second movable members 121, 122 from the third position to the fourth position.

As illustrated in FIGS. 4 and 5, the second stopper 110 is shaped like a plate having a substantially rectangular shape and larger in size than the first stopper 100. The second stopper 110 is also provided on the support surface 92A of the discharge tray 92. A second storage 98 is recessed in the central portion of the support surface 92A in the widthwise direction WF and a right end portion of the support surface 92A, and this second storage 98 is a substantially rectangular hole having a closed bottom. The second stopper 110 is stored in the second storage 98 in a state in which the second stopper 110 is laid.

As illustrated in FIG. 5, the second stopper 110 includes a shaft 111. The shaft 111 has a circular cylinder shape so as to extend through a right end portion of the second stopper 110 in its stored state and protrude therefrom frontward and rearward. Front and rear end portions of the shaft 111 are respectively supported by bearings, not shown, provided in the discharge tray 92. With this construction, the second stopper 110 is supported by the discharge tray 92 so as to be pivotable about a third axis X110 extending parallel to the widthwise direction WF. A position of the second stopper 110 is changeable between a laid position indicated by the solid lines in FIGS. 4 and 5 and a standing position indicated by the two-dot chain lines in FIG. 4.

The position of the second stopper 110 which is indicated by the two-dot chain lines in FIG. 4 is defined as a fifth position. The second stopper 110 at the fifth position protrudes substantially upright from the support surface 92A. The position of the second stopper 110 which is indicated by the solid lines in FIGS. 4 and 5 is defined as a sixth position. As illustrated in FIG. 4, the second stopper 110 is pivoted to the sixth position by falling from the fifth position toward an upstream side in the discharge direction D1. The entire second stopper 110 is stored in the second storage 98 at the sixth position. As a result, the second stopper 110 has no portion protruding from the support surface 92A, resulting in no inverse step in the discharge direction D1.

As illustrated in FIG. 5, the third axis X110 about which the second stopper 110 is pivoted is spaced apart from the discharge unit 48 in the discharge direction D1 at a second distance L2 greater than the first distance L1. The length L4 of the maximum-size sheet SH1 in the discharge direction D1 is less than the second distance L2. Thus, the second stopper 110 at the fifth position is contactable with the maximum-size sheet SH1 from a downstream side in the discharge direction D1. In other words, the second stopper 110 at the fifth position is contactable with a downstream edge of the maximum-size sheet SH1 in the discharge direction D1.

Operations and Effects

There will be next explained operations of the first stopper 100, the first and second movable members 121, 122, and the interlocking mechanism 140 constructed as described above.

There will be first explained the case where the A6 sheet SH2 is discharged onto the support surface 92A by the discharge rollers 48A and the nip rollers 48B.

In the case where the user desires a high degree of alignment of the A6 sheets SH2 on the support surface 92A, for example, when a plurality of the A6 sheets SH2 are conveyed, the first stopper 100 may be manually raised from the second position illustrated in FIG. 6A to the first position illustrated in FIG. 6B. In conjunction with this operation, the interlocking mechanism 140 pivots each of the first and second movable members 121, 122 from the fourth position illustrated in FIG. 6A to the third position illustrated in FIG. 6B. It is noted that in the case where the user does not desire a high degree of alignment of the A6 sheets SH2 on the support surface 92A, the first stopper 100 may be kept at the second position illustrated in FIG. 6A.

When the A6 sheet SH2 is discharged onto the support surface 92A by the discharge rollers 48A and the nip rollers 48B in the state in which the first stopper 100 is located at the first position, and each of the first and second movable members 121, 122 is located at the third position as indicated by the two-dot chain lines in FIG. 4 and illustrated in FIG. 6B, the sheet SH2 is first conveyed in the discharge direction D1 along the imaginary line K1 and then conveyed toward a downstream side in the discharge direction D1 while being pressed on the support surface 92A by the pressing members 50. With this construction, the A6 sheet SH2 is conveyed toward a downstream side in the discharge direction D1, with a leading edge portion of the A6 sheet SH2 being rubbed against the support surface 92A.

Here, the distance between the restraining surfaces 121A, 122A (illustrated in FIG. 4) of the respective first and second movable members 121, 122 in the widthwise direction WF is as illustrated in FIG. 5 set at the value slightly greater than the length W2 of the A6 sheet SH2 in the widthwise direction WF. Thus, the A6 sheet SH2 is conveyed toward the first stopper 100 located at the third position without brought into contact with the pressing surfaces 121B, 122B (illustrated in FIG. 6B) of the respective first and second movable members 121, 122. That is, the interlocking mechanism 140 is not operated.

As indicated by the two-dot chain lines in FIG. 6B, when a leading edge SH2A of the A6 sheet SH2 is brought into contact with an upstream surface of the first stopper 100 located at the first position in the discharge direction D1, the A6 sheet SH2 is positioned and aligned in the discharge direction D1. Also, one and the other edges of the A6 sheet SH2 in the widthwise direction WF are restrained by the respective restraining surfaces 121A, 122A of the first and second movable members 121, 122, whereby the A6 sheet SH2 is aligned also in the widthwise direction WF. It is noted that the sheet SH smaller in size than the A6 sheet SH2 such as the postcard-size sheet is aligned in the same manner in the discharge direction D1 and the widthwise direction WF.

There will be next explained the case where a sheet SH larger in size than the A6 sheet SH2 is discharged onto the support surface 92A by the discharge rollers 48A and the nip rollers 48B. It is noted that the sheet SH larger in size than the A6 sheet SH2 will be hereinafter referred to as "large sheet SH", and this large sheet SH includes the maximum-size sheet SH1.

When the first stopper 100 is located at the second position, and each of the first and second movable members 121, 122 is located at the fourth position as indicated by the solid lines in FIG. 4 and illustrated in FIG. 6A, the user keeps this state. On the other hand, when the first stopper 100 is located at the first position, and each of the first and second movable members 121, 122 is located at the third position as indicated by the two-dot chain lines in FIG. 4 and illustrated in FIG. 6B, the user may manually fall the first stopper 100 from the first position illustrated in FIG. 6B to the second position illustrated in FIG. 6A. In conjunction with this operation, the interlocking mechanism 140 pivots each of the first and second movable members 121, 122 from the third position illustrated in FIG. 6B to the fourth position illustrated in FIG. 6A.

Also, as indicated by the two-dot chain lines in FIG. 4, the user may manually pivot the second stopper 110 to the fifth position.

When the large sheet SH is discharged onto the support surface 92A by the discharge rollers 48A and the nip rollers 48B in the state in which the first stopper 100 is located at the second position, and each of the first and second movable members 121, 122 is located at the fourth position as indicated by the solid lines in FIG. 4 and illustrated in FIG. 6A, the large sheet SH is as illustrated in FIG. 6C conveyed toward a downstream side in the discharge direction D1, with a leading edge portion of the large sheet SH being rubbed against the support surface 92A. Since the first stopper 100 and the first and second movable members 121, 122 form no inverse step in the discharge direction D1 during this conveyance, the large sheet SH is not caught by the first stopper 100 and the first and second movable members 121, 122. The large sheet SH is aligned in the discharge direction D1 by being brought into contact with an upstream surface of the second stopper 110 located at the fifth position indicated by the two-dot chain lines in FIG. 4 in the discharge direction D1.

Here, in case where the user has forgotten falling the first stopper 100 manually, for example, the large sheet SH may be conveyed onto the support surface 92A by the discharge rollers 48A and the nip rollers 48B in the state in which the first stopper 100 is located at the first position, and each of the first and second movable members 121, 122 is located at the third position as indicated by the two-dot chain lines in FIG. 4 and illustrated in FIG. 6B. Even in this situation, the image reading apparatus 1 prevents a jam of the large sheet SH as follows.

That is, in the state in which the first stopper 100 is located at the first position, and each of the first and second movable members 121, 122 is located at the third position as indicated by the two-dot chain lines in FIG. 4 and illustrated in FIG. 6B, the large sheet SH to be discharged onto the support surface 92A is conveyed on the support surface 92A, with the leading edge portion of the large sheet SH being rubbed against the support surface 92A, in a state in which opposite side portions of the large sheet SH in the widthwise direction WF are located outside the passage region T in the widthwise direction WF. This large sheet SH presses the pressing surfaces 121B, 122B of the respective first and second movable members 121, 122, so that each of the first and second movable members 121, 122 is pivoted in the clockwise direction in FIG. 6 from the third position illustrated in FIG. 6B to the fourth position illustrated in FIG. 6C. In conjunction with this operation, the interlocking mechanism 140 pivots the first stopper 100 from the first position illustrated in FIG. 6B to the second position illustrated in FIG. 6C.

That is, when each of the first and second movable members 121, 122 is pressed in the discharge direction D1 by the large sheet SH conveyed on the support surface 92A, the interlocking mechanism 140 pivots the first stopper 100 from the first position to the second position in conjunction with the pivotal movement of each of the first and second movable members 121, 122 from the third position to the fourth position.

As a result, the large sheet SH to be discharged onto the support surface 92A is conveyed toward a downstream side in the discharge direction D1 and aligned by the second stopper 110 in the discharge direction D1 without caught by the first and second movable members 121, 122 and the first stopper 100.

In this image reading apparatus 1, the interlocking mechanism 140 including the coupling member 141 has a simple construction when compared with the size detector, the controller, and the stopper driving device in the above-described conventional image reading apparatus, resulting in reduced cost of components.

In the image reading apparatus 1 according to the first embodiment, accordingly, the simple construction improves a degree of alignment of discharged sheets for various sizes and reduces manufacturing costs.

In this image reading apparatus 1, as illustrated in FIG. 5, the length L3 of the A6 sheet SH2 in the discharge direction D1 is less than the first distance L1. As illustrated in FIG. 6B, the first stopper 100 at the first position is capable of contacting the leading edge SH2A of the A6 sheet SH2 from a downstream side in the discharge direction D1. Accordingly, the A6 sheet SH2 discharged by the discharge unit 48 is brought into contact with the first stopper 100 and thereby reliably aligned on the support surface 92A. In the case where the A6 sheets SH2 are successively discharged, for example, the sheet SH2 discharged later pushes the sheet SH2 discharged previously in the discharge direction D1. Also in this case, leading edges of the sheets SH2 are restrained by the first stopper 100, preventing the sheets SH2 from scattering on the support surface 92A.

In this image reading apparatus 1, as illustrated in FIGS. 6A-6C, the interlocking mechanism 140 pivots the first stopper 100 from the first position to the second position in conjunction with the pivotal movement of each of the first and second movable members 121, 122 from the third position to the fourth position due to each of the first and second movable members 121, 122 being pressed in the discharge direction D1 by the large sheet SH conveyed on the support surface 92A. This construction saves the user from having to manually pivot each of the first and second movable members 121, 122 from the fourth position to the third position.

In this image reading apparatus 1, as illustrated in FIGS. 4 and 5, the first movable member 121 is disposed on one of opposite sides of the passage region T in the widthwise direction WF, and the second movable member 122 is disposed on the other of opposite sides of the passage region T in the widthwise direction WF. Thus, when the first and second movable members 121, 122 contact the downstream edge of the large sheet SH larger than the A6 sheet SH2 in the discharge direction D1, the first and second movable members 121, 122 uniformly contact one and the other side portions of the large sheet SH in the widthwise direction WF, thereby preventing skew of the large sheet SH.

In this image reading apparatus 1, as illustrated in FIGS. 4 and 5, the restraining surfaces 121A, 122A of the respective first and second movable members 121, 122 restrain the A6 sheet SH2 from opposite sides thereof in the widthwise direction WF, thereby reliably preventing positional misalignment of the A6 sheet SH2 in the widthwise direction WF.

In this image reading apparatus 1, as illustrated in FIGS. 6A-6C, the first stopper 100 is supported by the discharge tray 92 so as to be pivotable about the first axis X100 extending parallel to the widthwise direction WF, and this first stopper 100 is pivoted from the first position to the second position by falling toward an upstream side in the discharge direction D1. Each of the first and second movable members 121, 122 is supported by the discharge tray 92 so as to be pivotable about the second axis X120 extending parallel to the widthwise direction WF, and each of the first and second movable members 121, 122 is pivoted from the third position to the fourth position by falling toward a downstream side in the discharge direction D1. With the above-described construction, the first stopper 100 located at the first position is not easily pivoted to the second position even when the first stopper 100 is pressed by the A6 sheet SH2 in the discharge direction D1. Accordingly, the first stopper 100 reliably aligns the A6 sheet SH2. On the other hand, when pressed by the large sheet SH in the discharge direction D1, each of the first and second movable members 121, 122 located at the third position is easily pivoted to the fourth position. This configuration allows the pivotal movement of the first and second movable members 121, 122 to be reliably transferred to the first stopper 100 via the interlocking mechanism 140 without interfering with discharge of the large sheet SH.

In this image reading apparatus 1, as illustrated in FIGS. 5 and 6A-6C, the interlocking mechanism 140 includes the coupling member 141 substantially shaped like a rod. The one end 141A of the coupling member 141 is coupled to the first stopper 100 via the transmitter 102, and the other end 141B of the coupling member 141 is coupled to the first and second movable members 121, 122 via the pivoting member 142 and the transmission shaft 123. This simple construction using the coupling member 141 reliably reduces manufacturing costs.

In this image reading apparatus 1, as illustrated in FIG. 6B, the first and second movable members 121, 122 have the respective pressing surfaces 121B, 122B standing substantially upright on the support surface 92A and oriented toward an upstream side in the discharge direction D1 when each of the first and second movable members 121, 122 is located at the third position. Thus, each of the pressing surfaces 121B, 122B of the respective first and second movable members 121, 122 well receives a pressing force of the large sheet SH and is thereby reliably pivoted from the third position to the fourth position.

In this image reading apparatus 1, as illustrated in FIG. 6B, the discharge unit 48 includes the discharge rollers 48A and the nip rollers 48B opposed to the respective discharge rollers 48A so as to form the nip position N1. The distal edges 121C, 122C of the respective first and second movable members 121, 122 at the third position are located above the imaginary line K1 extending in the discharge direction D1 through the nip position N1. Accordingly, when the large sheet SH is discharged in the discharge direction D1 while being nipped by the discharge rollers 48A and the nip rollers 48B, the large sheet SH reliably presses the first and second movable members 121, 122 each located at the third position.

In this image reading apparatus 1, as illustrated in FIGS. 5 and 6A-6C, the discharge unit 48 includes the pressing members 50 for pressing the sheet SH to be discharged in the discharge direction D1, onto the support surface 92A. The first and second movable members 121, 122 each located at the third position overlap the respective pressing members 50 in position in the discharge direction D1. Accordingly, when the large sheet SH is discharged in the discharge direction D1, the large sheet SH pressed onto the support surface 92A by the pressing members 50 reliably pushes the first and second movable members 121, 122 each located at the third position.

As illustrated in FIGS. 4 and 5, this image reading apparatus 1 includes the second stopper 110. The second stopper 110 located at the fifth position protrudes from the support surface 92A at the position located downstream of the discharge unit 48 in the discharge direction D1 at the second distance L2 greater than the first distance L1. Accordingly, in the case where the sheet SH (e.g., the large sheet SH) larger than the first distance L1 and smaller than the second distance L2 in length in the discharge direction D1 is conveyed, the sheet SH conveyed on the first stopper 100 located at the second position is aligned by the second stopper 110.

Second Embodiment

Figure 7:
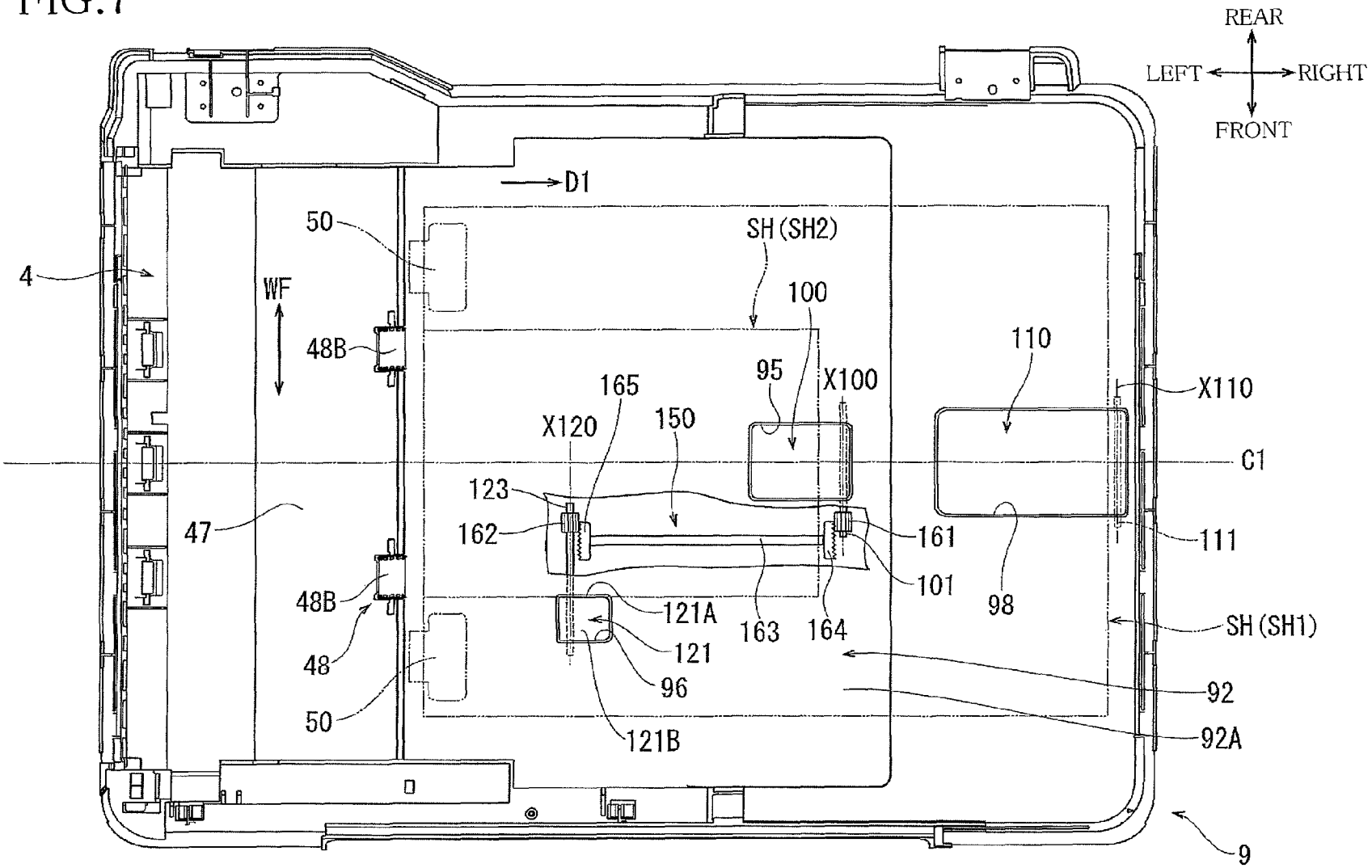
FIG. 7 is a top view illustrating a discharge unit, a discharge tray, first and second stoppers, a movable member, an interlocking mechanism, and other components in an image reading apparatus according to a second embodiment.

As illustrated in FIG. 7, an image reading apparatus according to the second embodiment does not include the second movable member 122 of the first and second movable members 121, 122 in the first embodiment. Also, the image reading apparatus according to the second embodiment includes an interlocking mechanism 150 instead of the interlocking mechanism 140 in the first embodiment. The other construction in the second embodiment is similar to that in the first embodiment. Thus, the same reference numerals as used in the first embodiment are used to designate the corresponding elements of this second embodiment, and an explanation of which is dispensed with.

In this second embodiment, the length of the transmission shaft 123 is reduced because the second movable member 122 is removed.

The interlocking mechanism 150 is provided between the first stopper 100 and the first movable member 121. The interlocking mechanism 150 includes a transmission gear group constituted by a first pinion gear 161, a second pinion gear 162, a transmission shaft 163, a first crown gear 164, and a second crown gear 165.

The first pinion gear 161 is attached to the shaft 101 of the first stopper 100 so as to be rotatable together with the shaft 101. The second pinion gear 162 is attached to the transmission shaft 123 so as to be rotatable together with the transmission shaft 123. The transmission shaft 163 is shaped like a circular cylinder extending in the right and left direction from a position near the first pinion gear 161 to a position near the second pinion gear 162. The transmission shaft 163 is supported by bearings, not shown, provided in the discharge tray 92. The first crown gear 164 is attached to a right end of the transmission shaft 163 so as to be rotatable together with the transmission shaft 163. The first crown gear 164 is meshed with the first pinion gear 161. The second crown gear 165 is attached to a left end of the transmission shaft 163 so as to be rotatable together with the transmission gear 163. The second crown gear 165 is meshed with the second pinion gear 162. Power transmission of the transmission gear group is well known, and a detailed explanation thereof is dispensed with.

Like the interlocking mechanism 140 in the first embodiment, the interlocking mechanism 150 is capable of pivoting the first movable member 121 from the fourth position to the third position in conjunction with the pivotal movement of the first stopper 100 from the second position to the first position and capable of pivoting the first stopper 100 from the first position to the second position in conjunction with the pivotal movement of the first movable member 121 from the third position to the fourth position.

In the image reading apparatus according to the second embodiment, accordingly, the simple construction improves a degree of alignment of discharged sheets for various sizes and reduces manufacturing costs as in the first embodiment. Also, this image reading apparatus includes the interlocking mechanism 150 including the simple gear group, thereby reliably reducing manufacturing costs.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

The interlocking mechanism is not limited in construction to those in the first and second embodiments. For example, the interlocking mechanism may be an interlocking mechanism including pulleys and timing belts and may be an interlocking mechanism including a flexible guide tube and a wire movable in the guide tube.

The interlocking mechanism may not only pivot the first stopper from the first position to the second position but also pivot the second stopper from the sixth position to the fifth position in conjunction with pivotal movement of the movable member from the third position to the fourth position. Also, the interlocking mechanism may include a plural sets of the movable members, the stoppers, and the interlocking mechanisms.

The present disclosure may be applied to image reading apparatuses, image forming apparatuses, and multi-function peripherals (MFPs), for example.

What is claimed is:

1. A sheet conveying apparatus, comprising:

a conveyor configured to convey a sheet along a conveyance path; and an discharge tray comprising a support surface configured to support the sheet discharged from the conveyor, the conveyor comprising an discharge unit constituting a portion of the conveyor and configured to discharge the sheet conveyed along the conveyance path, onto the discharge tray, the discharge tray comprising:

a first stopper provided on the support surface, the first stopper being changeable in position between a first position at which the first stopper protrudes from the support surface such that an upper end of the first stopper is positioned above the support surface, and a second position at which the first stopper is stored in the discharge tray;

a movable member provided on the support surface between the discharge unit and the first stopper in a discharge direction in which the discharge unit discharges the sheet, the discharge direction being perpendicular to a widthwise direction, the movable member being changeable in position between a third position at which the movable member protrudes from the support surface, and a fourth position located nearer to the support surface than the third position, the movable member being different in position from a passage region in the widthwise direction in a state in which the movable member is located at the third position, the passage region being a region which is defined on the support surface and on which a particular sheet is conveyed, a length of the particular sheet in the widthwise direction being equal to a particular length; and an interlocking mechanism configured to change a position of the first stopper in conjunction with a change in position of the movable member, the interlocking mechanism being configured to change the position of the first stopper from the first position to the second position in conjunction with a change in position of the movable member from the third position to the fourth position.

2. The sheet conveying apparatus according to claim 1, wherein the first stopper is disposed downstream of the conveyor in the discharge direction at a first distance, wherein a length of the particular sheet in the discharge direction is less than the first distance, and wherein the first stopper located at the first position is capable of contacting a leading edge of the particular sheet discharged by the discharge unit.

3. The sheet conveying apparatus according to claim 2, wherein the discharge tray comprises a second stopper disposed downstream of the discharge unit in the discharge direction at a second distance greater than the first distance.

4. The sheet conveying apparatus according to claim 1, wherein the interlocking mechanism is configured to:

change the position of the first stopper from the first position to the second position in conjunction with the change in position of the movable member from the third position to the fourth position when the movable member is pushed in the discharge direction by the sheet conveyed on the support surface; and change the position of the movable member from the fourth position to the third position in conjunction with a change in position of the first stopper from the second position to the first position.

5. The sheet conveying apparatus according to claim 1, wherein the movable member comprises:

a first movable member disposed on one of opposite outer sides of the passage region in the widthwise direction; and a second movable member disposed on another of the opposite outer sides of the passage region in the widthwise direction.

6. The sheet conveying apparatus according to claim 1, wherein the movable member comprises a restraining surface capable of restraining the particular sheet from at least one of the opposite outer sides of the passage region in the widthwise direction in the state in which the movable member is located at the third position.

7. The sheet conveying apparatus according to claim 1, wherein the first stopper is supported by the discharge tray so as to be pivotable about a first axis extending parallel to the widthwise direction and is configured to fall from the first position toward an upstream side thereof in the discharge direction to change the position of the first position to the second position, and wherein the movable member is supported by the discharge tray so as to be pivotable about a second axis extending parallel to the widthwise direction and is configured to fall from the third position toward a downstream side thereof in the discharge direction to change the position of the movable member to the fourth position.

8. The sheet conveying apparatus according to claim 1, wherein the interlocking mechanism comprises a coupling member of a substantially rod shape, and wherein one of opposite ends of the coupling member is coupled to the first stopper, and another of the opposite ends of the coupling member is coupled to the movable member.

9. The sheet conveying apparatus according to claim 1, wherein the interlocking mechanism comprises a transmission gear group comprising:

a first gear coupled to the first stopper;

a second gear coupled to the movable member; and at least one meshing gear meshed with the first gear and the second gear.

10. The sheet conveying apparatus according to claim 1, wherein the movable member comprises a pressing surface standing substantially upright on the support surface and oriented toward an upstream side in the discharge direction in the state in which the movable member is located at the third position.

11. The sheet conveying apparatus according to claim 1, wherein the discharge unit comprises a discharge roller and a nip roller opposed to the discharge roller so as to define a nip position, and wherein a distal edge of the movable member located at the third position is located above an imaginary line extending in the discharge direction through the nip position.

12. The sheet conveying apparatus according to claim 1, wherein the discharge unit comprises a pressing member configured to press the sheet being discharged in the discharge direction, onto the support surface, and wherein a range occupied by the movable member in the widthwise direction overlaps a range occupied by the pressing member in the widthwise direction.

13. The sheet conveying apparatus according to claim 1, further comprising a reading device provided at an intermediate portion of the conveyance path and configured to read an image recorded on the sheet conveyed by the conveyor.

* * * * *